US008955936B2

(12) United States Patent
Yoshimoto

(10) Patent No.: US 8,955,936 B2
(45) Date of Patent: Feb. 17, 2015

(54) PRINTING APPARATUS AND CONTROL METHOD FOR THE SAME

(75) Inventor: Takuya Yoshimoto, Chofu (JP)

(73) Assignee: Canon Kabushiki Kaisha, Tokyo (JP)

( * ) Notice: Subject to any disclaimer, the term of this patent is extended or adjusted under 35 U.S.C. 154(b) by 123 days.

(21) Appl. No.: 13/360,341

(22) Filed: Jan. 27, 2012

(65) Prior Publication Data

US 2012/0212533 A1 Aug. 23, 2012

(30) Foreign Application Priority Data

Feb. 17, 2011 (JP) ..... 2011-032626

(51) Int. Cl.
*B41J 29/38* (2006.01)
*B41J 2/045* (2006.01)

(52) U.S. Cl.
CPC ..... *B41J 29/38* (2013.01); *B41J 2/04553* (2013.01); *B41J 2/04563* (2013.01); *B41J 2/0458* (2013.01); *B41J 2/0459* (2013.01); *B41J 2/04591* (2013.01); *B41J 2/04598* (2013.01)
USPC ..... 347/14; 347/17

(58) Field of Classification Search
CPC .... B41J 2/0458; B41J 2/04563; B41J 29/393; B41J 2/04591; B41J 2/04581
USPC ..... 347/5–19, 93
See application file for complete search history.

(56) References Cited

U.S. PATENT DOCUMENTS

| | | | | |
|---|---|---|---|---|
| 2006/0214962 | A1* | 9/2006 | Takata | 347/14 |
| 2008/0259146 | A1* | 10/2008 | Suzuki | 347/93 |
| 2009/0040257 | A1* | 2/2009 | Bergstedt et al. | 347/17 |
| 2010/0149243 | A1* | 6/2010 | Sheahan et al. | 347/14 |

FOREIGN PATENT DOCUMENTS

| | | | |
|---|---|---|---|
| JP | 5-24199 | A | 2/1993 |
| JP | 8-336962 | A | 12/1996 |
| JP | 10-16228 | A | 1/1998 |

* cited by examiner

*Primary Examiner* — Manish S Shah
*Assistant Examiner* — Yaovi Ameh
(74) *Attorney, Agent, or Firm* — Fitzpatrick, Cella, Harper & Scinto

(57) ABSTRACT

A printing apparatus includes a first control unit that controls execution of a first temperature adjusting operation in which heating is performed in a region in which all of orifices are arranged; a second control unit that controls execution of a second temperature adjusting operation in which, compared to a predetermined region in which a predetermined number of orifices from respective ends in an orifice arrangement direction are arranged in the orifice arrangement direction, heating is performed with a lower extent of heating in a region in which the orifices outside the predetermined region are arranged; and a temperature adjusting control unit that controls execution of a multi-stage temperature adjusting operation performed on a printhead that includes the first temperature adjusting operation and the second temperature adjusting operation by controlling the first control unit and the second control unit before printing starts.

22 Claims, 14 Drawing Sheets

| | |
|---|---|
| 1ST TEMPERATURE ADJUSTING OPERATION | ALL HEATERS (1-640) |
| 2ND TEMPERATURE ADJUSTING OPERATION | REGION E: 1-48, 593-640<br>REGION C1-1: 49-320 (4n: 52, 56, 60, ..., 312, 316, 320)<br>REGION C1-2: 321-592 (4n+1: 321, 325, 329, ..., 581, 585, 589) |

FIG. 10A
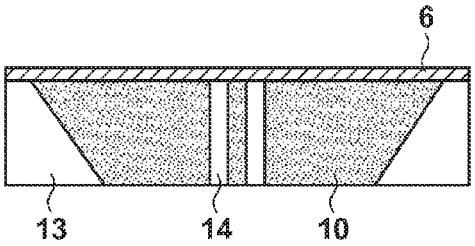
FIG. 10B
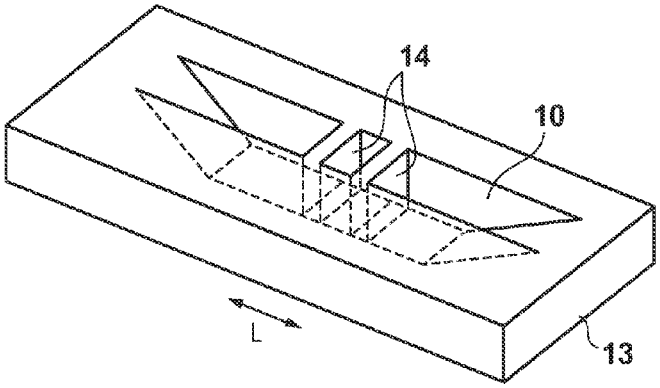
FIG. 10C
| | |
|---|---|
| 1ST TEMPERATURE ADJUSTING OPERATION | ALL HEATERS (1-640) |
| 2ND TEMPERATURE ADJUSTING OPERATION | REGION E: 1-48, 593-640<br>REGION C1-1: 49-256, 305-320<br>(4n: 52, 56, 60, ..., 256, 308, 312, 316, 320)<br>REGION C1-2: 321-336, 385-592<br>(4n+1: 321, 325, 329, 333, 385, 389, ..., 589)<br>REGION C2-1: 257-304 (2n: 258, 260, ..., 304)<br>REGION C2-2: 337-384 (2n+1: 337, 339, ..., 383) |

FIG. 13

| | |
|---|---|
| 1ST TEMPERATURE ADJUSTING OPERATION | ALL HEATERS (1-640) |
| 2ND TEMPERATURE ADJUSTING OPERATION | REGION E: 1-64, 577-640<br>REGION C1-1: 65-320 (4n: 68, 72, 76, ..., 312, 316, 320)<br>REGION C1-2: 321-576 (4n+1: 321, 325, 329, ..., 569, 573) |

PRINTING APPARATUS AND CONTROL METHOD FOR THE SAME

BACKGROUND OF THE INVENTION

1. Field of the Invention

The present invention relates to a printing apparatus a control method for the same.

2. Description of the Related Art

There are known to be printing apparatuses that employ an inkjet printing system. With such printing apparatuses, an image is printed onto a printing medium by discharging ink from an array of orifices on a printhead while moving the printhead back and forth. As a means for discharging ink droplets, such printing apparatuses employ, for example, a method of using air bubbles generated by electrothermal transducers (hereinafter, referred to as "discharge heaters") such as heater elements. Features of this kind of printing system utilizing heat include, for example, enabling easily reducing the apparatus size and increasing image resolution.

With a printing system that utilizes heat, an electrical signal (hereinafter, referred to as a "pulse") is applied to the discharge heaters in the printhead so that the electrical signal is converted into thermal energy. This thermal energy is then used to cause film boiling to occur in ink, and ink is discharged using the bubble formation pressure of the air bubbles generated by the film boiling. The discharged ink droplets thus land on a printing medium, and dots are formed on the printing medium.

In such a printing system utilizing heat, it is known that the ink discharge amount fluctuates depending on the viscosity of the ink. Since the ink viscosity changes a large amount depending on the temperature, the ink discharge amount fluctuates depending on the temperature of the ink in the vicinity of the discharge heaters. Specifically, the ink discharge amount increases if the temperature of the ink in the vicinity of a discharge heater is high. This is because the higher the temperature is, the lower the ink viscosity is, and thus the fluidity of the ink improves. Another cause for this is that the growth of the air bubbles formed by film boiling is increasingly promoted as the temperature rises.

For this reason, the temperature of the printhead rises due to the generation of heat by the discharge heaters in printing and the like, and this temperature rise causes the ink discharge amount to increase compared to before the rise in the temperature of the printhead. Thermal energy is also generated due to the application of a pulse to the discharge heaters. For this reason, if the discharge heaters are indiscriminately energized, the temperature is higher the closer to the center in a temperature distribution in the arrangement direction of the discharge heaters, such as in the case of uniformly applying a heating value to a metal rod. As a result, the ink discharge amount is different between high-temperature places and low-temperature places.

In such a case, variation occurs in the diameter of the dots that are formed when ink droplets land on a printing medium, thus leading to the possibility of uneven density in the printed image and degradation in print quality. This problem arises prominently in cases where the discharge heaters are driven with a higher frequency and where the number of orifices is increased in order to meet recent demands for high-speed printing.

Incidentally, with an orifice that has not been used for a certain period of time, the viscosity of ink in the vicinity of the orifice increases (the ink thickens) due to the evaporation of volatile components of the ink from the surface in contact with the air, which may cause the ink to not be discharged satisfactorily. When this phenomenon occurs, an increase in ink concentration and a reduction in ink discharge speed occur particularly at the beginning of printing. In a worst-case scenario, ink may fail to be discharged.

In order to address such a situation, in consideration of the fact that ink viscosity decreases as the temperature rises, it can be said to be effective to reduce the ink viscosity by heating the ink. In light of this, there are known to be mainly two methods of resolving the problem of discharge instability due to ink thickening.

The first is a method of heating the printhead by driving the discharge heaters, and the second is a method of heating the printhead by providing a heater for heating the printhead (hereinafter referred to as a "sub-heater") separately from the discharge heaters.

With the first method, a pulse according which ink film boiling does not occur, such as a pulse having a short pulse width (hereinafter referred to as a "short pulse"), is applied to the discharge heaters so that the printhead is heated without discharging ink. With the second method, the printhead is heated by applying an arbitrary pulse to the sub-heater.

The technology described below is known as techniques for performing heating using discharge heaters. Japanese Patent Laid-Open No. 10-16228 (hereinafter referred to as "Document 1") proposes a method of performing heating by applying a short pulse in a non-printing period at an appropriate duty that is in accordance with a printhead temperature condition (the duty being 100% in the case of applying a short pulse with the same frequency as the driving frequency of the printhead during printing). Japanese Patent Laid-Open No. 5-24199 (hereinafter referred to as "Document 2") proposes a method of performing heating by applying a short pulse to discharge heaters that are not used during printing. Also, Japanese Patent Laid-Open No. 8-336962 (hereinafter referred to as "Document 3") proposes a method of performing heating in a non-printing period that includes an acceleration region in printhead scanning.

In Document 1, heating is performed by changing the duty as described above, and even when such heating is performed, a pulse is applied to all of the discharge heaters. For this reason, the temperature in the orifice array is not uniform along the orifice arrangement direction, and the temperature is higher in the vicinity of the center of the orifice array than in the vicinity of the ends of the orifice array. Also, with Document 3 as well, the temperature is not uniform in the orifice array similarly to the case of Document 1. Such temperature bias becomes prominent particularly in the case where heating is performed quickly in order to perform high-speed printing.

Furthermore, in Document 2, a short pulse is applied to discharge heaters not used during printing, and actually realizing this processing requires the implementation of circuitry for applying a discharge pulse and a heating pulse at the same time during printing. This results in a cost increase for both the printhead and the apparatus.

With a method of performing heating using discharge heaters in this way, the temperature distribution of the orifice array along the orifice arrangement direction is generally not uniform. For this reason, if an attempt is made to heat all of the discharge orifices to a target temperature or more, the target temperature is overshot in some places. Specifically, when the vicinity of the ends of the orifice array is sufficiently heated, the temperature in the vicinity of the center of the orifice array rises more than anticipated. In other words, it can be said that an excessive amount of power is consumed.

Meanwhile, although there is a method of preventing temperature overshooting by providing a rest period, an excessive amount of time is consumed in this method in order to achieve uniformity in the aforementioned temperature distribution. Also, uniformity cannot be achieved in the temperature distribution, and the ink discharge amount fluctuates, thus causing density unevenness in the printed image particularly at the start of printing.

On the other hand, although the method of performing heating using a sub-heater can achieve greater uniformity in the aforementioned temperature distribution than is possible in the methods of performing heating using discharge heaters, the extra sub-heater, wiring, and the like need to be provided, thus leading to an increase in cost.

SUMMARY OF THE INVENTION

The present invention provides technology that enables executing a printing operation with a stable ink discharge amount from the start of printing, while suppressing a rise in cost.

According to a first aspect of the present invention there is provided a printing apparatus comprising: a printhead that has arranged thereon a plurality of orifices that have electrothermal transducers that generate thermal energy to be applied to ink in order to discharge the ink using the thermal energy; a first control unit that controls execution of a first temperature adjusting operation in which heating is performed in a region in which all of the orifices are arranged by applying a voltage to each of the electrothermal transducers corresponding to the orifices; a second control unit that controls execution of a second temperature adjusting operation in which, compared to a predetermined region in which a predetermined number of orifices from respective ends in an orifice arrangement direction are arranged in the orifice arrangement direction, heating is performed with a lower extent of heating in a region in which the orifices outside the predetermined region are arranged by applying a voltage to each electrothermal transducer that corresponds to any of orifices among the plurality orifices; and a temperature adjusting control unit that controls execution of a multi-stage temperature adjusting operation performed on the printhead that includes the first temperature adjusting operation and the second temperature adjusting operation by controlling the first control unit and the second control unit before printing starts.

According to a second aspect of the present invention there is provided a control method for a printing apparatus that has a printhead and prints an image on a printing medium using the printhead, the printhead having arranged thereon a plurality of orifices that have electrothermal transducers that generate thermal energy to be applied to ink in order to discharge the ink using the thermal energy, the control method comprising: controlling, by a first control unit, execution of a first temperature adjusting operation in which heating is performed in a region in which all of the orifices are arranged by applying a voltage to each of the electrothermal transducers corresponding to the orifices; controlling, by a second control unit, execution of a second temperature adjusting operation in which, compared to a predetermined region in which a predetermined number of orifices from respective ends in an orifice arrangement direction are arranged in the orifice arrangement direction, heating is performed with a lower extent of heating in a region in which the orifices outside the predetermined region are arranged by applying a voltage to each electrothermal transducer that corresponds to any of orifices among the plurality orifices; and controlling, by a temperature adjusting control unit, execution of a multi-stage temperature adjusting operation performed on the printhead that includes the first temperature adjusting operation and the second temperature adjusting operation by controlling the first control unit and the second control unit before printing starts.

Further features of the present invention will be apparent from the following description of exemplary embodiments with reference to the attached drawings.

BRIEF DESCRIPTION OF THE DRAWINGS

The accompanying drawings, which are incorporated in and constitute a part of the specification, illustrate embodiments of the invention, and together with the description, serve to explain the principles of the invention.

FIGS. 10A to 10C are diagrams for illustrating an overview of Embodiment 2.

FIG. 13 is a diagram showing an example of temperature adjusting conditions in a first temperature adjusting operation and a second temperature adjusting operation according to Embodiment 4.

DESCRIPTION OF THE EMBODIMENTS

Exemplary embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

In this specification, "printing" means not only forming significant information such as characters or graphics but also forming, for example, an image, design, pattern, or structure on a printing medium in a broad sense regardless of whether the formed information is significant, or processing the medium as well. In addition, the formed information need not always be visualized so as to be visually recognized by humans.

Also, a "printing medium" means not only a paper sheet for use in a general printing apparatus but also a member which can fix ink, such as cloth, plastic film, metallic plate, glass, ceramics, resin, lumber, or leather in a broad sense.

Also, "ink" should be interpreted in a broad sense as in the definition of "printing" mentioned above, and means a liquid which can be used to form, for example, an image, design, or pattern, process a printing medium, or perform ink processing upon being supplied onto the printing medium. The ink processing includes, for example, solidification or insolubilization of a coloring material in ink supplied onto a printing medium.

Also, a "nozzle" generically means an orifice, a liquid channel which communicates with it, and an element which generates energy used for ink discharge, unless otherwise specified.

Embodiment 1

Figure 1:
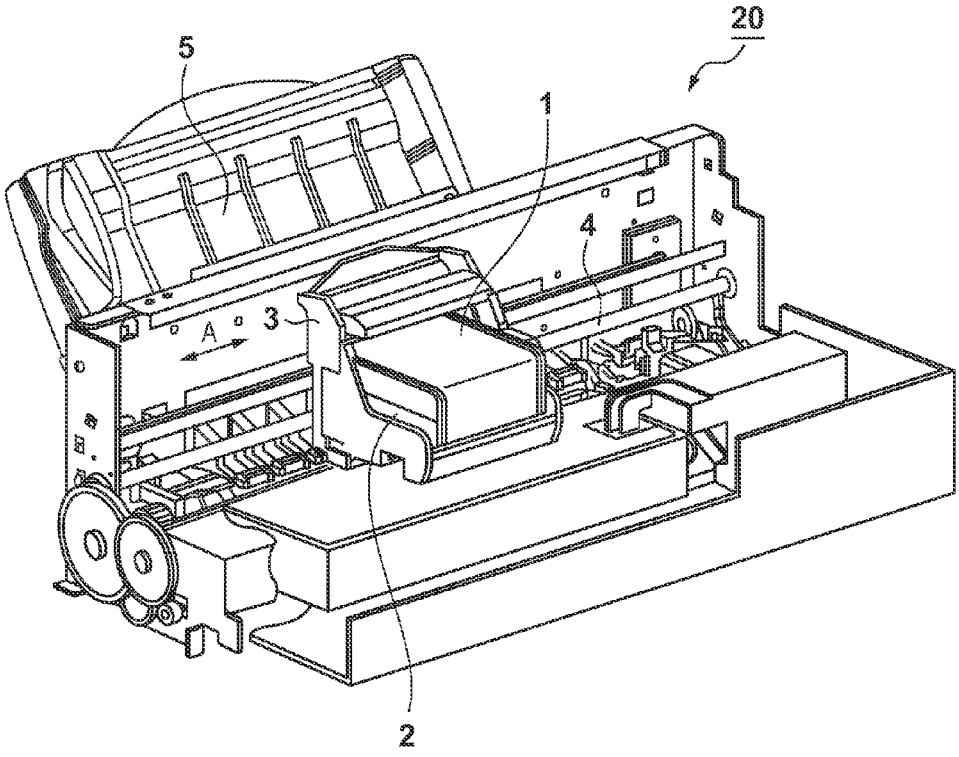
FIG. 1 is a perspective view of an example of a configuration of a printing apparatus according to an embodiment of the present invention.

FIG. 1 is a perspective view of an example of the configuration of an inkjet printing apparatus (hereinafter, simply referred to as a "printing apparatus") according to an embodiment of the present invention.

In a printing apparatus 20, an inkjet printhead (hereinafter, simply referred to as a "printhead") 2 for performing printing by discharging ink in accordance with an inkjet system is mounted in a carriage 3, and printing is performed by moving the carriage 3 back and forth in the arrow A direction (main-scanning direction) along a guide rail 4. In the printing apparatus 20, a printing medium is fed via a paper feed tray 5 and conveyed in a direction that is orthogonal to the arrow A (that is, in the sub-scanning direction). Ink is then discharged from the printhead 2 onto the printing medium at a print position that opposes the orifice surface of the printhead 2, and thus printing is performed. Here, when the carriage 3 has moved from one end of the printing medium to the other end, conveying rollers (not shown) convey the printing medium a predetermined amount in the sub-scanning direction of the carriage 3. This printing operation and printing medium conveying operation are alternately repeated so as to form an image on the entirety of the printing medium.

Orifices are formed in the printhead 2. These orifices are arranged along a predetermined direction (sub-scanning direction), thus constituting an orifice array. Note that multiple orifice arrays are provided (in the present embodiment, two orifice arrays are provided).

Electrothermal transducers are provided in one-to-one correspondence with the orifices. The electrothermal transducers generate thermal energy that is applied to ink in order to discharge the ink using the thermal energy.

Besides the printhead 2, an ink tank 1, for example, is mounted in the carriage 3 of the printing apparatus 20. The ink tank 1 stores ink that is supplied to the printhead 2. Note that the ink tank 1 is detachable from the carriage 3. Also, an environmental temperature sensor (not shown) that measures the environmental temperature is provided in the carriage 3 or the like.

In the printing apparatus 20 of the present embodiment, a temperature adjusting operation for adjusting the temperature of the printhead 2 is performed in order to reduce the ink viscosity while suppressing variation in the ink discharge amount when the environmental temperature is a predetermined temperature (e.g., 25° C.). Specifically, before (immediately before) the start of printing, the temperature distribution of the orifice array along the orifice arrangement direction is made uniform at a target temperature (e.g., approximately 40° C.) using discharge heaters (hereinafter, simply referred to as "heaters").

Figure 2A:
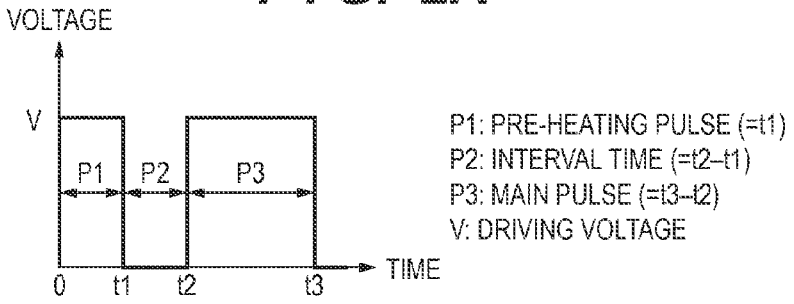
FIGS. 2A and 2B are diagrams showing examples of heater driving signals (pulses).
Figure 2B:
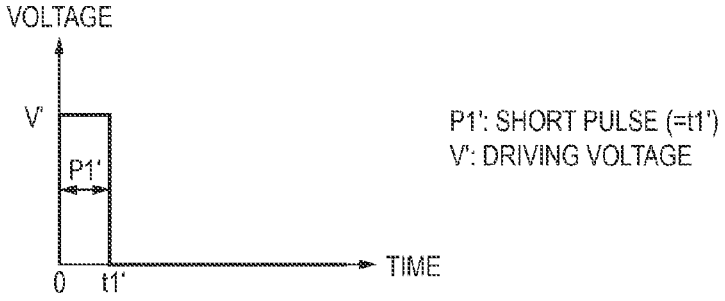

This temperature adjusting operation is performed through a voltage that is not effective for discharging ink, that is to say, according to which ink is not discharged, being applied to heaters. In the present embodiment, the temperature adjusting operation is performed on the printhead 2 using a technique of applying a short pulse (electrical signal having a short pulse width) to heaters. As shown in FIG. 2B, the short pulse is a pulse whose pulse width is shorter than that of a double pulse used for discharging ink, which is shown in FIG. 2A.

In the temperature adjusting operation of the present embodiment, two kinds of conditions are provided regarding, for example, the number and positions of heaters to which the short pulse is applied, and the width, voltage, and driving frequency of the short pulse. These two kinds of conditions (hereinafter referred to as "temperature adjusting conditions") enable performing temperature adjustment in stages (hereinafter referred to as a "two-stage temperature adjusting method"). In this two-stage temperature adjusting method, the temperature adjusting operation performed in accordance with a first temperature adjusting condition is referred to as the first temperature adjusting operation, and the temperature adjusting operation performed in accordance with a second temperature adjusting condition that is different from the first temperature adjusting condition is referred to as the second temperature adjusting operation. In the present embodiment, the second temperature adjusting operation is carried out after the first temperature adjusting operation has been performed.

Next is a description of an example of the configuration of the printhead 2 shown in FIG. 1.

Figure 3A:
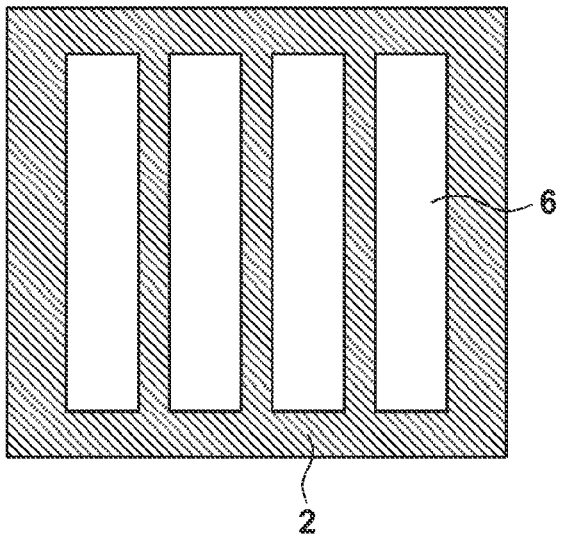
FIGS. 3A and 3B are diagrams showing an example of a configuration of a printhead 2 shown in FIG. 1.

As shown in FIG. 3A, the printhead 2 is provided with one or more element substrates 6 (hereinafter referred to as "heater boards") on each of which multiple orifices that include heaters (not shown) are formed. Note that in the case of FIG. 3A, four heater boards 6 are provided, and the heater boards 6 are respectively filled with yellow, magenta, cyan, and black ink.

Figure 3B:
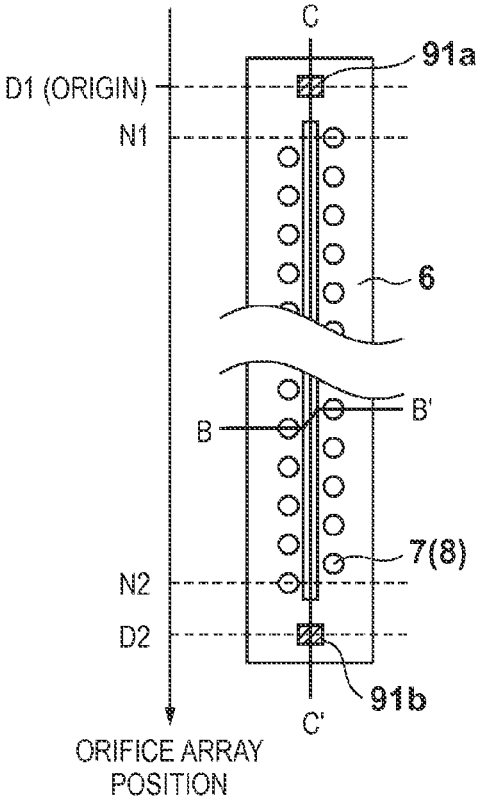

FIG. 3B is a diagram showing an overview of the configuration of one of the heater boards 6 shown in FIG. 3A. Multiple orifices 7 are formed on the heater board 6. The heater board 6 of the present embodiment has a length of approximately 1 inch in the longitudinal direction (that is, the orifice arrangement direction), and two orifice arrays are provided thereon, for example. Also, 640 orifices are provided in each orifice array.

Temperature sensors 91 (91*a* and 91*b*) for measuring the temperature of the printhead 2 (more specifically, the heater board 6) are provided at respective longitudinal ends of the heater board 6. Note that with the heater board 6 shown in FIG. 3B, D1 represents the positional coordinates of the first temperature sensor, D2 represents the positional coordinates of the second temperature sensor, N1 represents the positional coordinates of the first end of the orifice array, and N2 represents the positional coordinates of the second end of the orifice array.

The temperature sensors 91 described above are realized by diodes, for example. Generally, in the case of a thermal inkjet printing system, the orifices are formed densely on the same substrate, thus making it difficult for diodes used as temperature sensors to be disposed in the region where the orifice arrays are formed. In view of this, in the present embodiment, the temperature sensors 91 (91*a* and 91*b*) are disposed in the vicinity of the longitudinal ends of the heater board. Note that the temperature sensors 91 do not necessarily need to be disposed at such positions, and need only be disposed at any position outside the region where the orifices are disposed in the printhead 2. For example, it is possible to provide only one temperature sensor, or provide three or more temperature sensors. The greater the number of temperature sensors that are provided, the greater the precision in the detection of the temperature distribution of the orifice array along the orifice arrangement direction (hereinafter, sometimes simply referred to as the "orifice array temperature distribution").

Figure 4A:
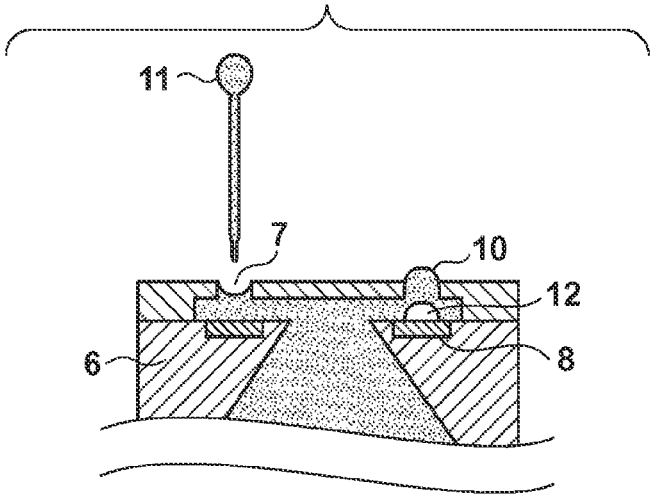
FIGS. 4A to 4C are diagrams showing an example of a configuration of the printhead.

FIG. 4A shows the schematic configuration of a lateral cross-section (cross-section taken along line B-B' in FIG. 3B) of the heater board 6. In the heater board 6, heaters 8 are provided substantially directly below the orifices 7 in order for ink 10 to be discharged from the orifices 7. Note that in the case of discharging the ink 10, thermal energy is applied to the heaters 8 so as to cause film boiling to occur in the ink 10. An air bubble 12 is formed due to the film boiling, and the ink 10 is discharged as an ink droplet 11 using the bubble formation pressure.

Figure 4B:
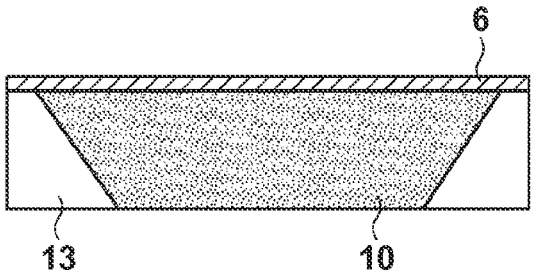
Figure 4C:
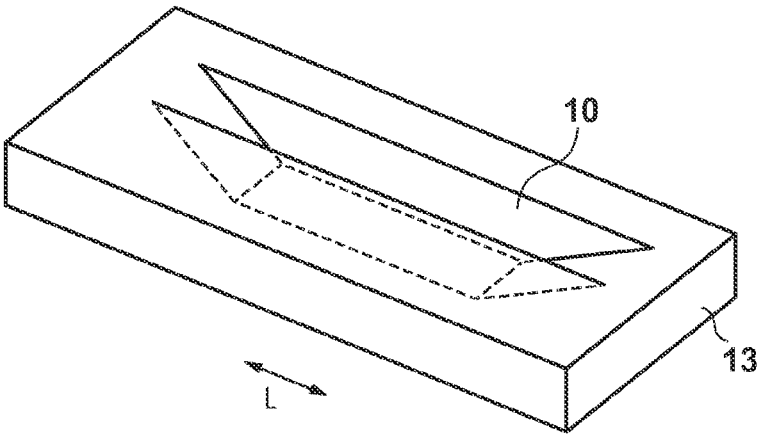

Also, FIG. 4B shows the schematic configuration of a longitudinal cross-section (cross-section taken along line C-C' in FIG. 3B) of the heater board 6 and a base plate 13 serving as the base thereof in the printhead 2. FIG. 4C is a perspective view of part of the base plate 13. Arrow L corresponds to the longitudinal direction of the heater board 6. As shown in FIG. 4B, the heater board 6 and the base plate 13 are formed so as to be in close contact. Accordingly, heat generated in the heater board 6 escapes to the base plate 13, thus preventing the temperature of the heater board 6 from becoming excessively high.

Figure 5:
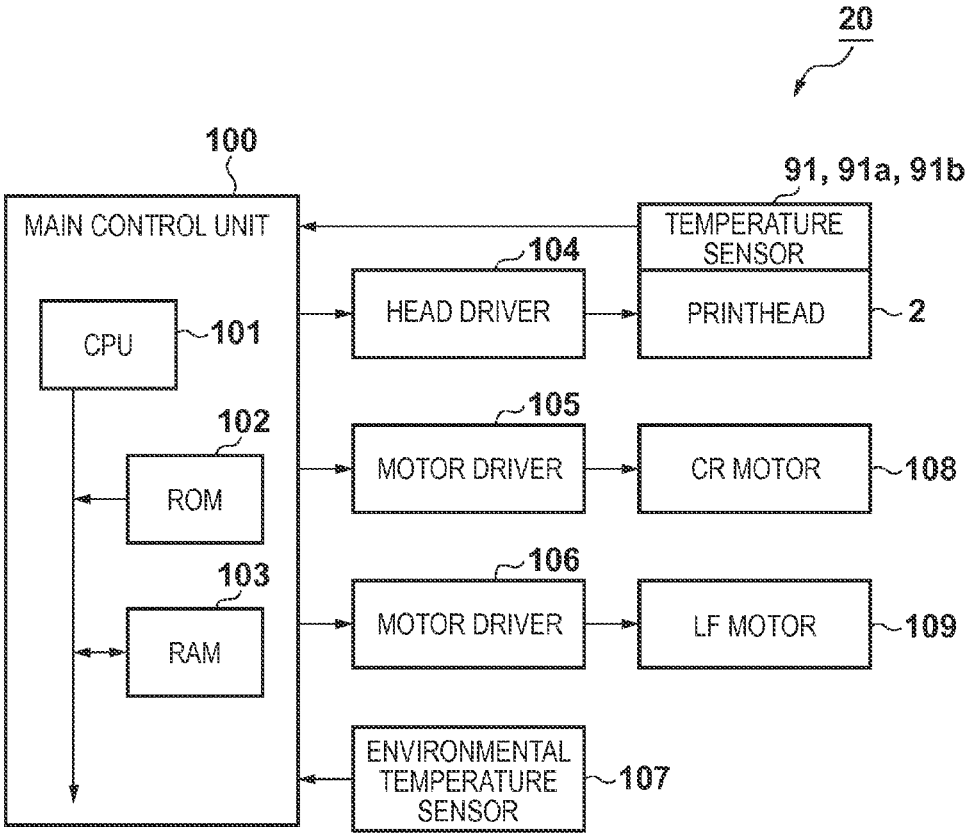
FIG. 5 is a diagram showing an example of a configuration of a control system in a printing apparatus 20 shown in FIG. 1.

Next is a description of an example of the configuration of a control system in the printing apparatus 20 shown in FIG. 1, with reference to FIG. 5.

The printing apparatus 20 is configured including a main control unit 100, a head driver 104, motor drivers 105 and 106, an environmental temperature sensor 107, the temperature sensors 91, the printhead 2, a CR motor 108, and an LF motor 109.

The main control unit 100 performs overall control of processing in the printing apparatus 20. For example, the main control unit 100 controls the execution of a printing sequence and the like. The main control unit 100 is configured included a CPU 101, a ROM 102 that stores data indicating a pulse width and voltage and other fixed data, and a RAM 103 that is used as, for example, a work area for the CPU 101. Note that a detection value detected by the temperature sensors 91 provided in the printhead 2 is input to the main control unit 100.

The head driver 104 drives the heaters of the printhead 2 in accordance with print data and the like. The CR motor 108 is a drive source for moving the carriage 3 in the main-scanning direction (arrow A direction in FIG. 1), and the motor driver 105 is the driver for the CR motor 108. The LF motor 109 is a drive source for conveying the printing medium, and the motor driver 106 is the driver for the LF motor 109. The environmental temperature sensor 107 measures the environmental temperature. Note that the detection value detected by the environmental temperature sensor 107 is input to the main control unit 100.

Figure 6A:
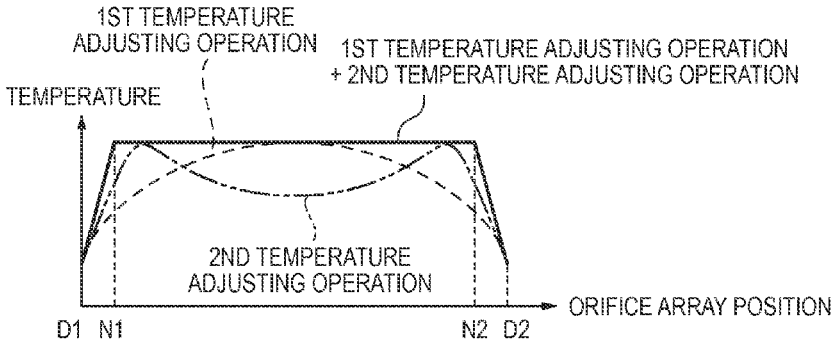
FIGS. 6A and 6B are diagrams for illustrating an overview of a two-stage temperature adjusting method according to an embodiment of the present invention.
Figure 6B:
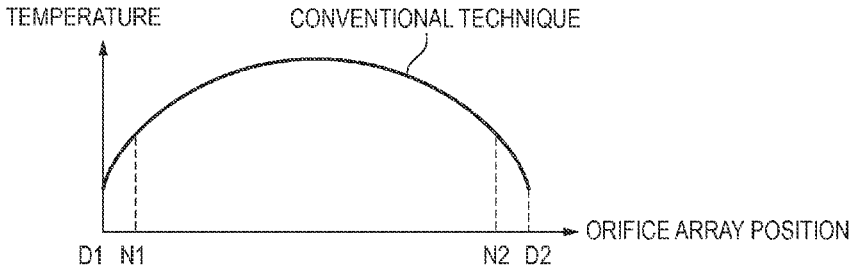

The following describes an overview of the two-stage temperature adjusting method of the present embodiment with reference to FIGS. 6A and 6B. Note that FIGS. 6A and 6B show a temperature distribution of an orifice array along the orifice arrangement direction, where FIG. 6A shows a temperature distribution according to the present embodiment, and FIG. 6B shows a temperature distribution according to a conventional example.

In the first temperature adjusting operation, the printhead 2 is heated by evenly applying a heating value to all of the orifices included in an orifice array. After the first temperature adjusting operation has been performed, the temperature distribution obtained at the end thereof is a mountain-shaped distribution in which the highest temperature is in the vicinity of the center of the orifice array. In particular, in the case where the orifice array length is long at approximately 1 inch, and furthermore the orifice array is heated quickly, there is a strong tendency for such a mountain-shaped distribution to be obtained.

In the second temperature adjusting operation, the printhead 2 is heated in a manner such that the heating value in the vicinity of the center of the orifice array is lower than that in the vicinity of the ends of the orifice array. More specifically, the printhead 2 is heated in a manner such that compared to the extent of heating in a predetermined region in which a predetermined number of orifices from respective ends in the orifice arrangement direction are arranged in the orifice arrangement direction, the extent of heating is lower in a region in which the orifices outside the predetermined region are arranged. In other words, the temperature is raised to a greater extent in the vicinity of the ends of the orifice array, in which the temperature is relatively lower than that in the vicinity of the center of the orifice array.

By executing the first temperature adjusting operation and the second temperature adjusting operation, the orifice array temperature distribution obtained at the end of these temperature adjusting operations is substantially uniform from the ends to the center along the orifice arrangement direction.

Also, at the end of the first temperature adjusting operation, more thermal energy is stored in the vicinity of the center of the orifice array than in the vicinity of the ends of the orifice array. After transitioning to the second temperature adjusting operation, the thermal energy stored in the vicinity of the center of the orifice array spreads toward the ends of the orifice array. Additionally, the temperature is raised by heating in the vicinity of the ends of the orifice array through the second temperature adjusting operation. Due to the combination of these two effects, the temperature is made uniform in the orifice array along the orifice arrangement direction at the end of the second temperature adjusting operation, that is to say, before (immediately before) the start of printing.

Furthermore, in the second temperature adjusting operation, the vicinity of the center of the orifice array is heated with a lower extent of heating than that in the first temperature adjusting operation. This is done in order to prevent a reduction in temperature in the vicinity of the center of the orifice array due to the spreading of thermal energy to the surroundings.

In contrast, with a conventional technique, the temperature distribution of an orifice array along the orifice arrangement direction that is obtained after a predetermined temperature adjusting operation has ended is a mountain-shaped distribution in which the highest temperature is in the vicinity of the center of the orifice array, as shown in FIG. 6B. For this reason, the ink temperature differs depending on the orifice arrangement position, and this causes variation in the ink discharge amount.

Figures 7A, 7B:
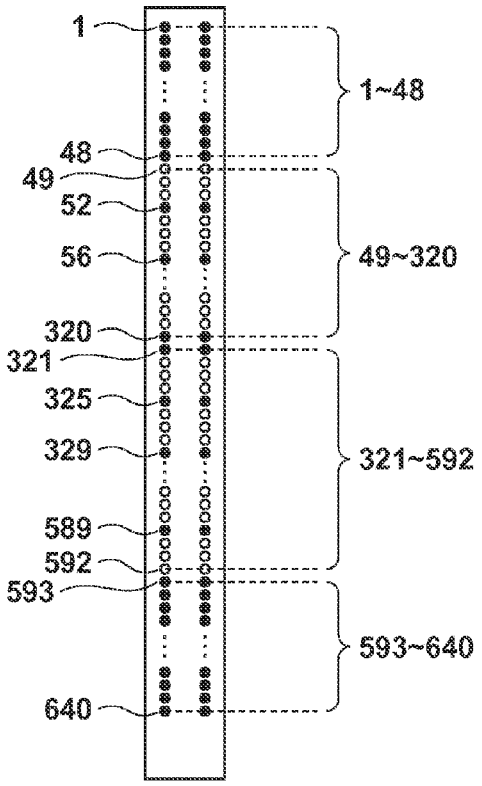
FIGS. 7A and 7B are diagrams showing an example of temperature adjusting conditions in a first temperature adjusting operation and a second temperature adjusting operation.

The following describes an example of temperature adjusting conditions in the first temperature adjusting operation and the second temperature adjusting operation with reference FIGS. 7A and 7B. The heaters shown here in the temperature adjusting conditions in the first temperature adjusting operation and the second temperature adjusting operation are an example of heaters targeted for heating (targeted for short pulse application) in the respective temperature adjusting operations. Note that FIGS. 7A and 7B show temperature adjusting conditions in the case of heating the printhead 2 to a target temperature of 40° C. when the environmental temperature is 25° C.

As shown in FIG. 7A, in the first temperature adjusting operation, a short pulse is applied to all of the heaters. In contrast, in the second temperature adjusting operation, a short pulse is not applied to all of the heaters. Here, the short pulses applied to the heaters in the first temperature adjusting operation and the second temperature adjusting operation both have an amplitude of 0.24 [μsec] and an application voltage of 24 [V]. The thermal resistance value of the discharge heaters is assumed to be 250[Ω]. Note that the pulse application time (that is, pulse width) and application voltage may be different between the first temperature adjusting operation and the second temperature adjusting operation.

As shown in FIG. 7A, in the second temperature adjusting operation, the heaters are divided into regions (in this case, three regions), and short pulse application is performed with respect to these regions. Specifically, as shown in FIG. 7B, short pulse application is performed with respect to a region E that includes heaters number 1 to number 48 and number 593 to number 640, with the heaters being numbered sequentially from a first end of the orifice array. Also, short pulse application is performed with respect to a region C1-1 that includes every 4n-th (n being a natural number) heater from number 49 to number 320, and a region C1-2 that includes every 4n+1-th heater from number 321 to number 592. These regions appear in the order of region E, regions C1 (region C1-1 and region C1-2), and then region E from the first end of the orifice array.

The region E is a region in which heating is performed with the same extent of heating as that in the first temperature adjusting operation. On the other hand, the region C1-1 and the region C1-2 are regions in which the heaters to which the short pulse is applied are thinned out (the short pulse is applied to ¼ the number of heaters) compared to the first temperature adjusting operation. In other words, the amount of heating in the region C1-1 and the region C1-2 is relatively lower than the amount of heating in the region E. The degree of heating is changed in each divided region (the region E and the regions C1). In this way, in the second temperature adjusting operation, heating control is performed such that a relatively higher heating value is applied in the vicinity of the ends of the orifice array than in the vicinity of the center of the orifice array, while preventing a reduction in temperature in the vicinity of the center of the orifice array.

Next is a description of the end timing of the first temperature adjusting operation and the second temperature adjusting operation.

As described above, the temperature sensors 91 are disposed at respective ends of the heater board 6 (along the orifice arrangement direction) in the printhead 2. Although the temperature of the ink in the vicinity of the orifices greatly influences the ink discharge amount, the temperature of the ink in the vicinity of the heaters and the orifice cannot be directly detected by the temperature sensors 91 disposed at the above-described positions. For this reason, the temperature needs to be predicted using some sort of method. Note that since the temperature sensors 91 are arranged at positions away from the heaters serving as the heat generation sources, it can be anticipated that the ink temperature in the vicinity of the heaters serving as the heat generation sources will be higher than the temperatures detected at the arrangement positions of the temperature sensors 91.

In view of this, the relationship that the orifice array temperature distribution (particularly the highest temperature) obtained when a short pulse is applied to heaters in accordance with the temperature adjusting condition in the first temperature adjusting operation has with the temperature detected by the temperature sensors 91 (hereinafter referred to as the "sensor temperature") is measured in advance and held in the printing apparatus 20. The first temperature adjusting operation and the second temperature adjusting operation are then performed in the printing apparatus 20 based on the held relationship. It is sufficient that this relationship between the temperature distribution and the sensor temperatures is obtained based on, for example, a predetermined experiment (in the present embodiment, a temperature measuring experiment performed using an infrared thermography). Note that this relationship may be derived analytically through simulation or the like. This relationship is obtained under multiple conditions with varied environmental temperatures and target temperatures, and the relationships between the positions and temperatures of the orifices along the orifice arrangement direction (orifice array temperature distribution), as well as the corresponding sensor temperatures are converted into data. This data is then, for example, held as a table (hereinafter referred to as a "temperature distribution table"). It is sufficient that the temperature distribution table is held in the RAM 103 or the like. Note that it is sufficient that the temperature adjusting condition (e.g., the pulse width, driving voltage, or the like) in the second temperature adjusting operation is determined by empirically searching for an optimum condition based on the temperature distribution table.

Here, the end timing of the first temperature adjusting operation is, for example, the time when the highest temperature in the orifice array temperature distribution has reached the target temperature. More specifically, the time when the temperature detected by the temperature sensors 91 has reached the sensor temperature (corresponding to the target temperature) held in the temperature distribution table. In other words, this end timing corresponds to the time when the highest temperature in the orifice array has reached the target temperature.

The end timing of the second temperature adjusting operation is the time when the orifice array temperature distribution has become substantially uniform, and furthermore the temperature thereof has substantially reached the target temperature. In other words, this end timing corresponds to the time when the orifice array temperature distribution has become substantially uniform.

When determining the end timing of the second temperature adjusting operation, similarly to the case of the first temperature adjusting operation, the relationship that the orifice array temperature distribution (particularly the highest temperature) obtained when a short pulse is applied to heaters in accordance with the temperature adjusting condition in the second temperature adjusting operation has with the sensor temperatures is obtained. A temperature distribution table for determining the end timing of the second temperature adjusting operation based on the held relationship is created and held in the printing apparatus 20. In other words, the end timing of the second temperature adjusting operation is determined based on this temperature distribution table (temperature distribution table for the second temperature adjusting operation).

Here, the target temperature is, for example, determined in advance based on the characteristics of the printing apparatus 20 and the printhead 2, and normally once it has been determined, the value of the target temperature is not changed. The target temperature is determined separately for each printing apparatus. Note that the target temperatures, the temperature adjusting conditions and end timing sensor temperatures for the first temperature adjusting operation and the second temperature adjusting operation, and the like are held in advance in the RAM 103 or the like. This information held in the RAM 103 or the like may be updated by being overwritten with update data downloaded from the Internet (or from a recording medium) or the like.

Note that as a method for determining the temperature adjusting condition for the second temperature adjusting operation, a configuration is possible in which the temperature distribution table for the first temperature adjusting operation is held in the RAM 103 or the like, and each time the second temperature adjusting operation is to be performed, the temperature adjusting condition for the second temperature adjusting operation is determined by prediction based on the temperature distribution table for the first temperature adjusting operation. More specifically, a configuration is possible in which a temperature rise rate is obtained for each orifice based on the temperature distribution table for the first temperature adjusting operation, and the temperature adjusting condition for the second temperature adjusting operation is obtained based on the obtained information.

Figure 8:
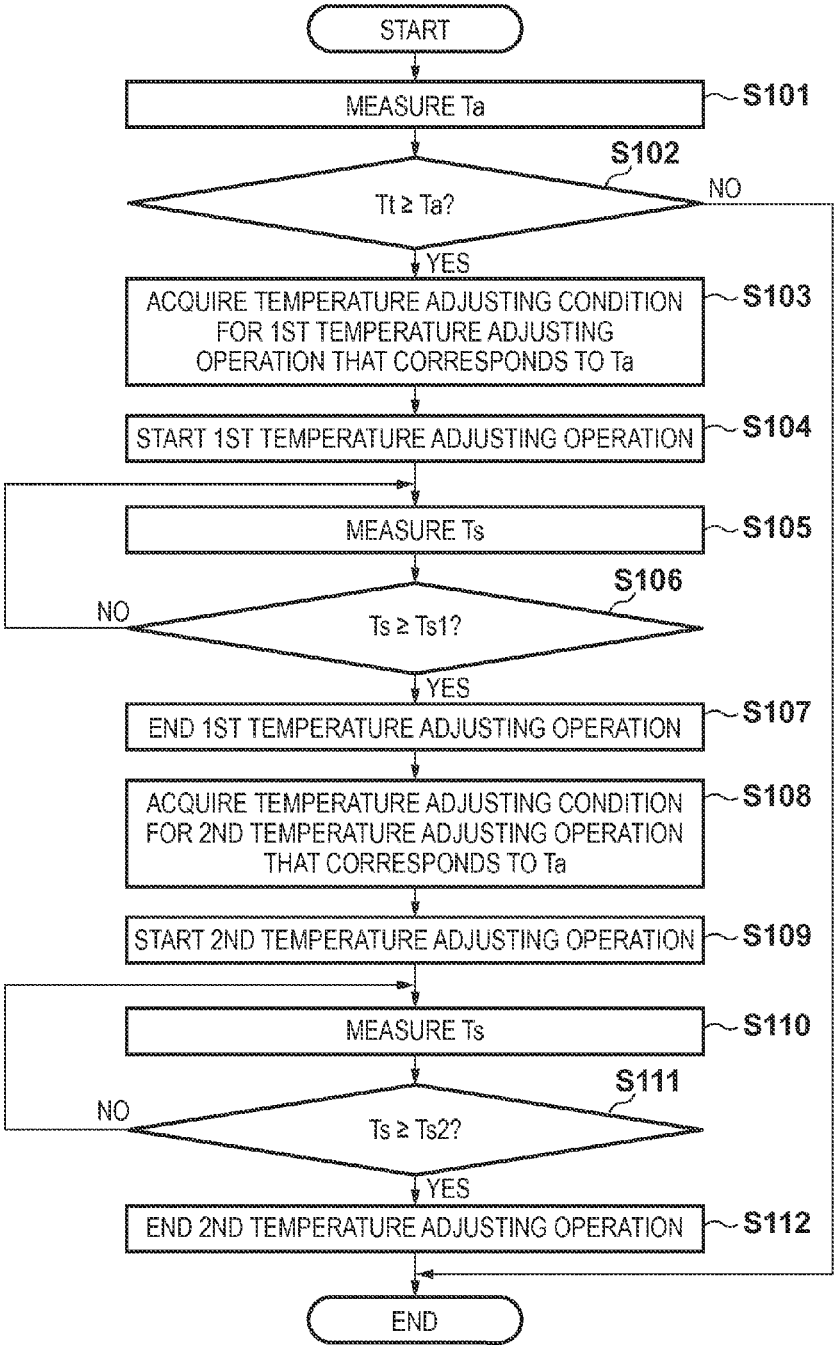
FIG. 8 is a flowchart showing an example of a flow of processing according to Embodiment 1.

The following describes an example of the flow of temperature adjusting control processing (two-stage temperature adjusting method) of Embodiment 1 with reference to FIG. 8. Here, it is assumed that the environmental temperature is Ta[° C.], the target temperature is Tt[° C.], and the sensor temperature is Ts[° C.]. It is assumed that the sensor temperature in the temperature distribution table for the first temperature adjusting operation (the corresponding sensor temperature when the highest temperature in the orifice array has reached the target temperature) is Ts1[° C.]. Also, it is assumed that the sensor temperature in the temperature distribution table for the second temperature adjusting operation (the sensor temperature when the orifice array temperature distribution has become substantially uniform) is Ts2[° C.].

When this processing starts, in the printing apparatus 20, first the environmental temperature sensor 107 measures Ta (environmental temperature) (S101), and the CPU 101 determines whether Tt (target temperature) is greater than or equal to Ta. If Tt is greater than or equal to Ta (YES in S102), the printing apparatus 20 starts two-stage temperature adjusting processing. On the other hand, if Tt is less than Ta (NO in S102), this processing ends. In other words, the printing operation is started since the temperature of the ink in the vicinity of the heaters and the orifices has risen sufficiently.

Subsequently, the CPU 101 of the printing apparatus 20 acquires, from the RAM 103 or the like, the temperature adjusting condition for the first temperature adjusting operation based on Ta that was detected in the processing of S101 (S103). For example, the CPU 101 acquires the Ts1 that corresponds to the environmental temperature and the target temperature. Note that the driving voltage and pulse width for the first temperature adjusting operation may also be acquired. The CPU 101 of the printing apparatus 20 then controls execution of the first temperature adjusting operation (first control processing). Specifically, the first temperature adjusting operation is started in accordance with the temperature adjusting condition acquired in S103 (S104).

When the first temperature adjusting operation is started, in the printing apparatus 20, the temperature sensors 91 measure Ts (sensor temperature) (S105), and the CPU 101 determines whether Ts has reached Ts1, which indicates the end of the first temperature adjusting operation. If Ts has not reached Ts1 (NO in S106), the measurement of Ts is continued, and if Ts has reached Ts1 (YES in S106), the printing apparatus 20 ends the first temperature adjusting operation (S107).

Next, the CPU 101 of the printing apparatus 20 acquires, from the RAM 103 or the like, the temperature adjusting condition for the second temperature adjusting operation based on Ta that was detected in the processing of S101 (S108). For example, the CPU 101 acquires the Ts2 that corresponds to the environmental temperature and the target temperature. Note that the driving voltage and pulse width for the second temperature adjusting operation may also be acquired. The CPU 101 of the printing apparatus 20 then controls execution of the second temperature adjusting operation (second control processing). Specifically, the second temperature adjusting operation is started in accordance with the temperature adjusting condition acquired in S108 (S109).

When the second temperature adjusting operation is started, in the printing apparatus 20, the temperature sensors 91 measure Ts (sensor temperature) (S110), and the CPU 101 determines whether Ts has reached Ts2, which indicates the end of the second temperature adjusting operation. If Ts has not reached Ts2 (NO in S111), the measurement of Ts is continued, and if Ts has reached Ts2 (YES in S111), the printing apparatus 20 ends the second temperature adjusting operation (S112). Accordingly, the two-stage temperature adjusting processing ends.

Figure 9A:
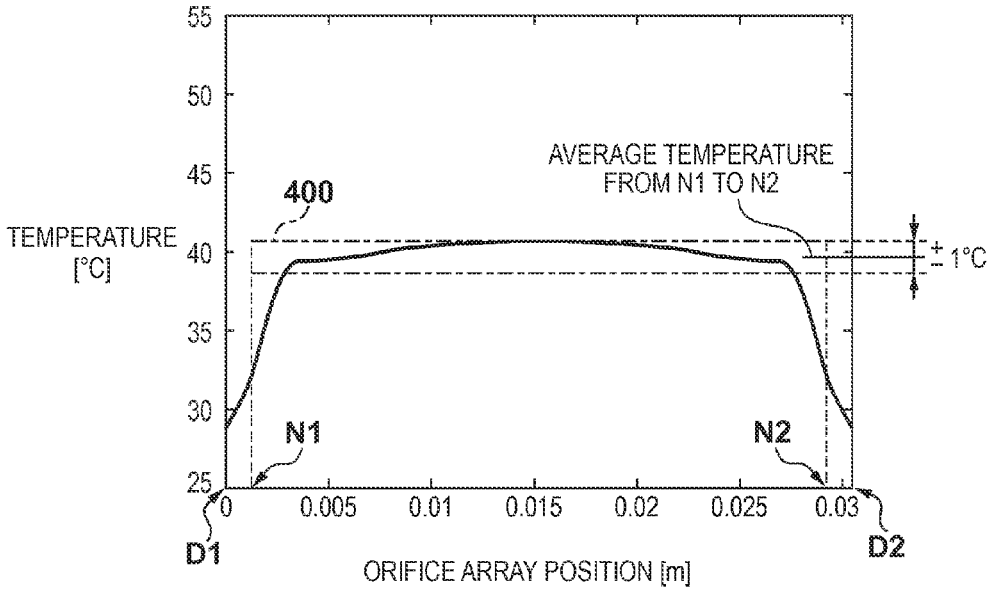
FIGS. 9A and 9B are diagrams for illustrating a temperature distribution of an orifice array according to Embodiment 1.
Figure 9B:
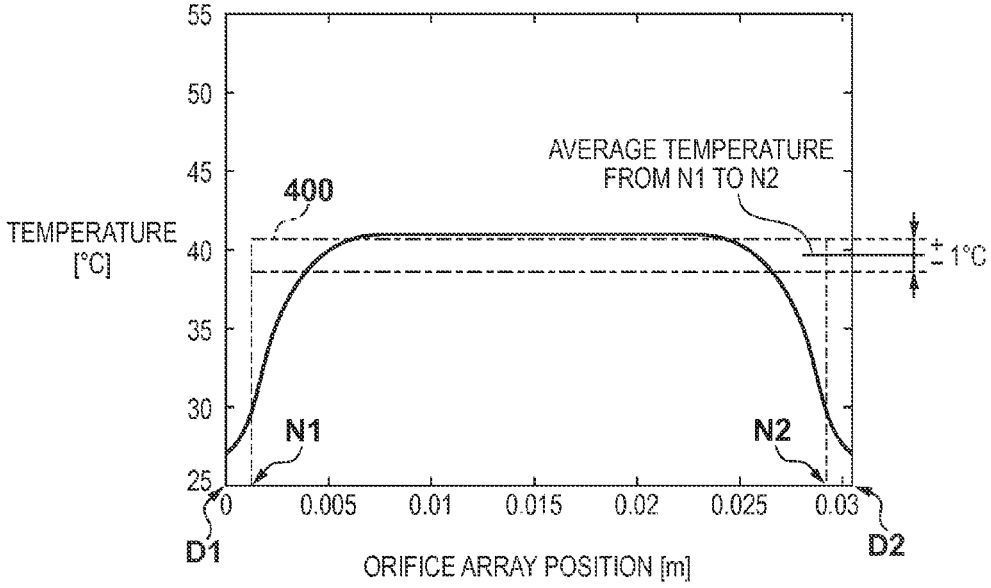

The following describes the orifice array temperature distribution (orifice array temperature distribution along the orifice arrangement direction) obtained after the above-described two-stage temperature adjusting processing has been carried out, with reference to FIG. 9A. In order to describe an effect of the present embodiment, FIG. 9B shows a conventional temperature distribution as a reference example. Note that N1, N2, D1, and D2 in FIG. 9A respectively correspond to the same reference signs shown in FIG. 3B.

In the following, "flatness rate" is defined as an indicator representing the uniformity (flatness) of the orifice array temperature distribution in the present embodiment. The flatness rate indicates the percentage of orifices that are in a temperature range of ±1° C. with respect to the average temperature between N1 and N2 serving as the central value. In FIGS. 9A and 9B, a broken-line box 400 indicates the targeted range. After the two-stage temperature adjusting processing was carried out with the target temperature of approximately 40° C., the orifice array temperature distribution at the time when the second temperature adjusting operation ended was empirically measured using an infrared thermography, and the flatness rate was calculated based on the measurement result.

FIG. 9B shows an orifice array temperature distribution obtained using a conventional technique as a reference example effective for greater understanding of an effect of the present embodiment. Note that in this conventional technique, a short pulse having the same driving voltage and pulse width as those of the present embodiment was applied to all of the discharge heaters until the target temperature was reached.

A comparison of the two temperature distributions shows that the flatness rate was approximately 89.1% in the temperature distribution of the present embodiment, and the flatness rate was approximately 24.5% with the conventional technique. It can be understood from these results that the temperature adjusting operation of the present embodiment can achieve greater flatness in the temperature distribution than the temperature adjusting operation of the conventional technique can. Specifically, in the case of performing heating until the same target temperature is reached, there is less temperature variation with the temperature adjusting operation of the present embodiment than with the temperature adjusting operation in the conventional technique. Accordingly, the temperature adjusting operation of the present embodiment can be said to be superior to the temperature adjusting operation in the conventional technique in terms of realizing flatness in the temperature distribution.

As described above, according to the present embodiment, the first temperature adjusting operation for heating all of the heaters is performed, and thereafter the second temperature adjusting operation, in which the extent of heating is lower in the region of the central portion of the orifice array than in the predetermined range from the ends of the orifice array, is performed.

Accordingly, the orifice array temperature distribution along the orifice arrangement direction is made uniform, thus enabling executing the printing operation with a stable ink discharge amount from the start of printing. As a result, the volume of discharged ink droplets can be made uniform, thus making it possible for unevenness in an image that occurs due to fluctuation in the ink discharge amount to be prevented from the start of printing.

More specifically, in the present embodiment, a mountain-shaped temperature distribution in which the highest temperature is in the vicinity of the center of the orifice array (most of the thermal energy is stored in the vicinity of the center of the orifice array) is obtained after the first temperature adjusting operation. Thereafter, this thermal energy stored in the vicinity of the center of the orifice array spreads toward the ends of the orifice array. The second temperature adjusting operation is executed along with this spreading of thermal energy, thus applying thermal energy to the heaters so as to supplement the spreading. The temperature distribution of the orifice array is thus made uniform.

Embodiment 2

Next is a description of Embodiment 2. Embodiment 2 describes the case of using a printhead 2 (heater board 6) that employs a different base plate 13 from that of Embodiment 1. Other aspects of the configuration will not be described since they are the same as in Embodiment 1.

FIG. 10A shows an example of the shape of the base plate 13 of Embodiment 2. FIG. 10B is a perspective view of part of the base plate 13. Arrow L corresponds to the longitudinal direction of the heater board 6. The base plate 13 of the present embodiment differs from the base plate 13 that is shown in FIG. 4C and described in Embodiment 1 in that two cross beams 14 made of the same material are provided extending in the lateral direction of the heater board 6 (the direction orthogonal to the orifice arrangement direction) in the vicinity of the center of the orifice array. In the case where the heater board 6 is long (approximately 1 inch) in the longitudinal direction, it can be anticipated that heat will tend to accumulate in the vicinity of the center of the orifice array, and therefore the above-described structure is employed in order to achieve a heat dissipation effect.

Note that similarly to Embodiment 1, the temperature adjusting conditions for the first temperature adjusting operation and the second temperature adjusting operation are determined based on temperature distribution tables created through, for example, a temperature measurement experiment using an infrared thermography. Also, the end timings of the first temperature adjusting operation and the second temperature adjusting operation are similar to those in Embodiment 1.

In Embodiment 2, the heaters targeted for short pulse application in the second temperature adjusting operation are different from those in the case of Embodiment 1, as shown in FIG. 10C. Note that FIG. 10C shows temperature adjusting conditions in the case of heating the printhead 2 to the target temperature of 40° C. when the environmental temperature is 25° C.

As shown in FIG. 10C, in the second temperature adjusting operation, the heaters are divided into five regions, and short pulse application is performed with respect to these regions. Specifically, short pulse application is performed with respect to a region E that includes all of the heaters number 1 to number 48 and number 593 to number 640, with the heaters being numbered sequentially from a first end of the orifice array. Also, short pulse application is performed with respect to a region C1-1 that includes every 4n-th (n being a natural number) heater from number 49 to number 256 and number 305 to number 320, and a region C1-2 that includes every 4n+1-th heater from number 321 to number 336 and number 385 to number 592. Also, short pulse application is performed with respect to a region C2-1 that includes every 2n-th heater from number 257 to number 304, and a region C2-2 that includes every 2n+1-th heater from number 337 to number 384. Specifically, these regions appear in the order of region E, region C1, region C2, region C1, region C2, region C1, and region E, from the first end of the orifice array. The regions C1 (region C1-1 and region C1-2) are regions in which the heaters to which the short pulse is applied are thinned out (the short pulse is applied to ¼ the number of heaters) compared to the first temperature adjusting operation. The regions C2 (region C2-1 and region C2-2) are regions in which the heaters to which the short pulse is applied are thinned out (the short pulse is applied to ½ the number of heaters) compared to the first temperature adjusting operation. In this way, in the second temperature adjusting operation, heating is performed by applying a higher heating value in the vicinity of the ends of the orifice array than in the vicinity of the center of the orifice array, while preventing a reduction in temperature in the vicinity of the center of the orifice array.

Here, the regions C2 include the heaters directly above the cross beams 14 of the base plate 13. Since the positions where the cross beams 14 are arranged achieve an effect of dissipating heat to the base plate 13, a higher heating value is set for the heater regions C2 than for the regions C1 in the present embodiment in order to prevent a reduction in temperature.

Figure 11A:
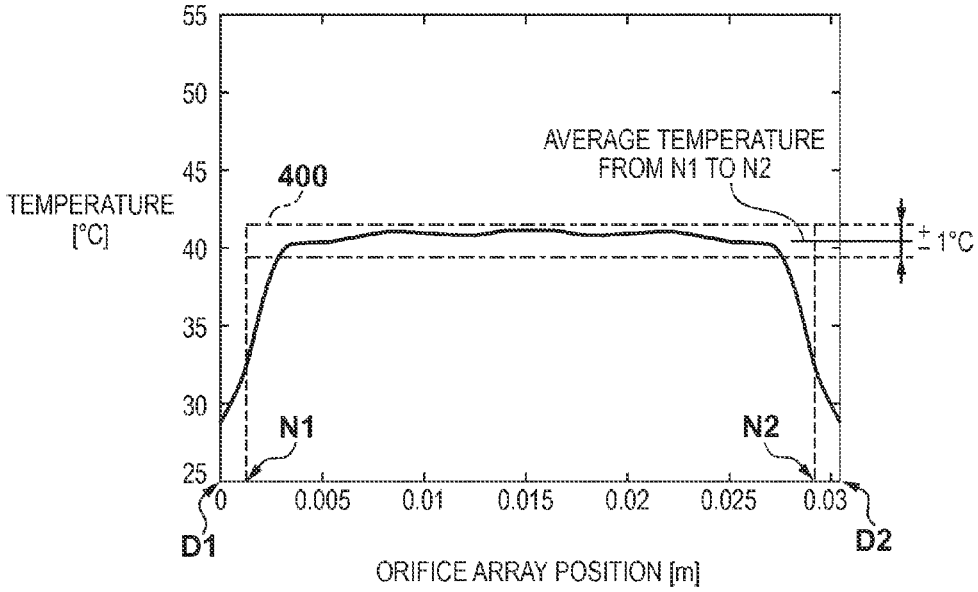
FIGS. 11A and 11B are diagrams for illustrating a temperature distribution of an orifice array according to Embodiment 2.
Figure 11B:
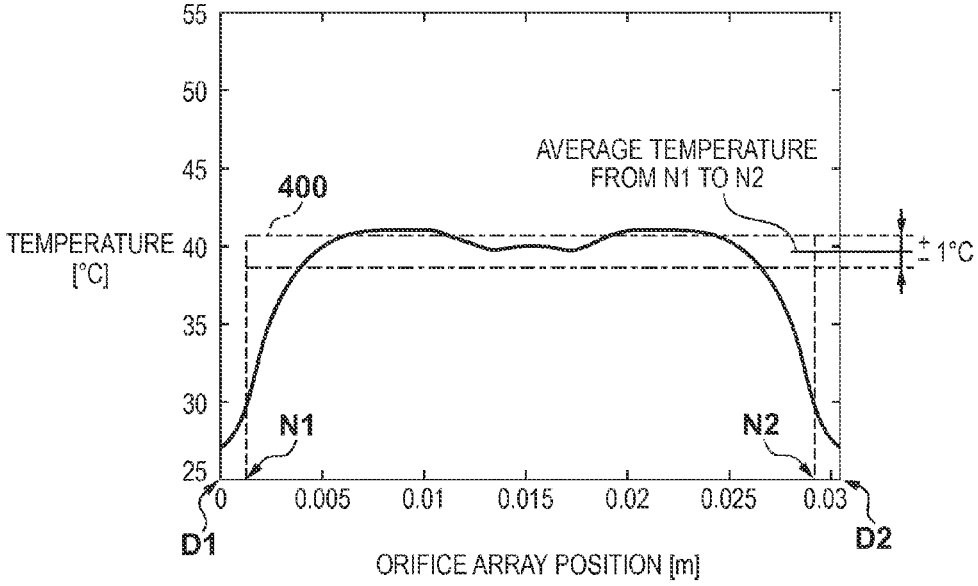

Next is a description of the orifice array temperature distribution obtained after two-stage temperature adjusting processing of Embodiment 2 has been carried out, with reference to FIG. 11A. In order to describe an effect of the present embodiment, FIG. 11B shows a conventional temperature distribution as a reference example. Note that N1, N2, D1, and D2 in FIG. 11A respectively correspond to the same reference signs shown in FIG. 3B.

Similarly to Embodiment 1, a flatness rate was calculated, and the flatness rate of Embodiment 2 will be compared with the flatness rate of the conventional technique. Note that a base plate 13 having the same configuration as that in Embodiment 2 was employed in the printhead 2 used in the conventional technique as well.

A comparison of the two temperature distributions shows that the flatness rate was approximately 90.9% in the temperature distribution of Embodiment 2, and the flatness rate was approximately 54.5% with the conventional technique. It can be understood from these results that the temperature adjusting operation of Embodiment 2 can achieve greater uniformity in the temperature distribution than the temperature adjusting operation of the conventional technique can.

Specifically, in the case of performing heating until the same target temperature is reached, there is less temperature variation with the temperature adjusting operation of the present embodiment than with the temperature adjusting operation in the conventional technique.

As described above, according to Embodiment 2, the orifice array temperature distribution along the orifice arrangement direction can be made uniform similarly to Embodiment 1 regardless of the shape of the base plate 13, thus enabling executing the printing operation with a stable ink discharge amount from the start of printing.

Embodiment 3

Next is a description of Embodiment 3. Embodiment 3 describes the case of switching the order of execution of the first temperature adjusting operation and the second temperature adjusting operation described in Embodiments 1 and 2. The configuration, various setting values, and the like of the printing apparatus 20 will not be described below since they are the same as those in Embodiment 1, and the following description will focus on differences from Embodiment 1.

Figure 12A:
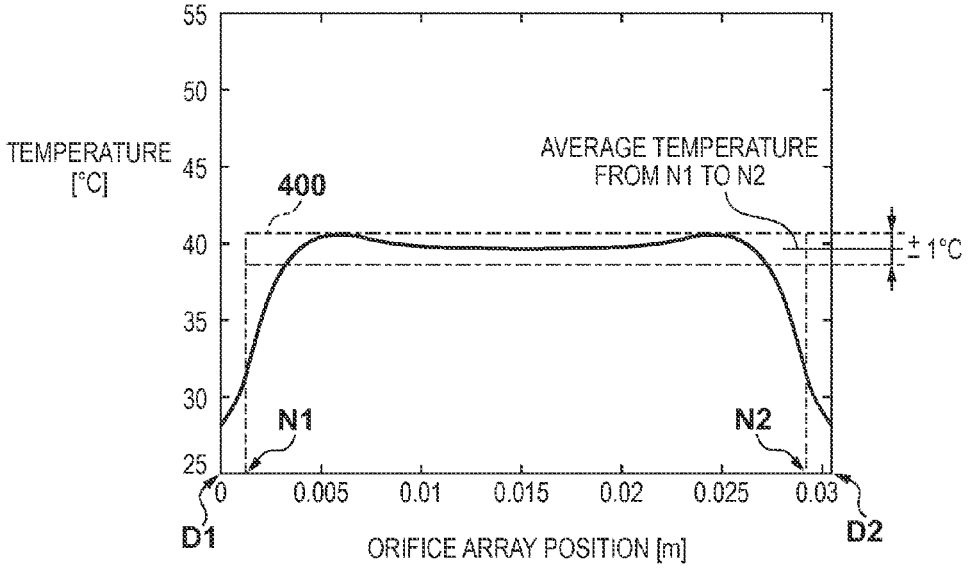
FIGS. 12A and 12B are diagrams for illustrating a temperature distribution of an orifice array according to Embodiment 3.
Figure 12B:
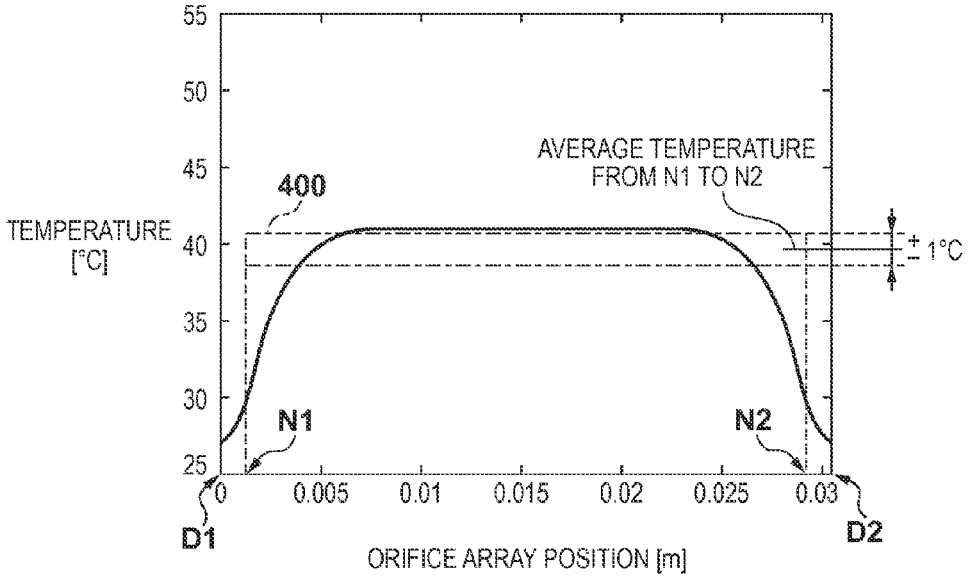

The following describes the orifice array temperature distribution obtained after two-stage temperature adjusting processing of Embodiment 3 has been carried out, with reference to FIG. 12A. In order to describe an effect of the present embodiment, FIG. 12B shows a conventional temperature distribution as a reference example. Note that N1, N2, D1, and D2 in FIG. 12A respectively correspond to the same reference signs shown in FIG. 3B.

Similarly to Embodiment 1, a flatness rate was calculated, and the flatness rate of Embodiment 3 will be compared with the flatness rate of the conventional technique. A comparison of the two temperature distributions shows that the flatness rate was approximately 88.2% in the temperature distribution of Embodiment 3, and the flatness rate was approximately 24.5% with the conventional technique. It can be understood from these results that the temperature adjusting operation of Embodiment 3 can achieve greater flatness in the temperature distribution than the temperature adjusting operation of the conventional technique can. Specifically, in the case of performing heating until the same target temperature is reached, there is less temperature variation with the temperature adjusting operation of the present embodiment than with the temperature adjusting operation in the conventional technique.

As described above, according to Embodiment 3, the orifice array temperature distribution along the orifice arrangement direction can be made more uniform than with the conventional configuration even in the case of switching the order of execution of the first temperature adjusting operation and the second temperature adjusting operation. This enables executing the printing operation with a stable ink discharge amount from the start of printing.

Embodiment 4

Next is a description of Embodiment 4. Note that the temperature adjusting conditions in Embodiment 4 are for the case of heating the printhead 2 to the target temperature of 40° C. when the environmental temperature is 15° C. The configuration, various setting values, and the like of the printing apparatus 20 will not be described below since they are the same as those in Embodiment 1, and the following description will focus on differences from Embodiment 1.

As shown in FIG. 13, in the second temperature adjusting operation of Embodiment 4, the heaters are divided into regions (in this case, three regions), and short pulse application is performed with respect to these regions. Specifically, short pulse application is performed with respect to a region E that includes heaters number 1 to number 64 and number 577 to number 640, with the heaters being numbered sequentially from a first end of the orifice array. Also, short pulse application is performed with respect to a region C1-1 that includes every 4n-th (n being a natural number) heater from number 65 to number 320, and a region C1-2 that includes every 4n+1-th heater from number 321 to number 576. These regions appear in the order of region E, regions C1 (region C1-1 and region C1-2), and then region E from the first end of the orifice array.

The region E is a region in which heating is performed with the same extent of heating as that in the first temperature adjusting operation. The region C1-1 and the region C1-2 are regions in which the heaters to which the short pulse is applied are thinned out (the short pulse is applied to ¼ the number of heaters) compared to the first temperature adjusting operation. Specifically, the degree of heating is changed in each divided region (the region E and the regions C1).

Figure 14A:
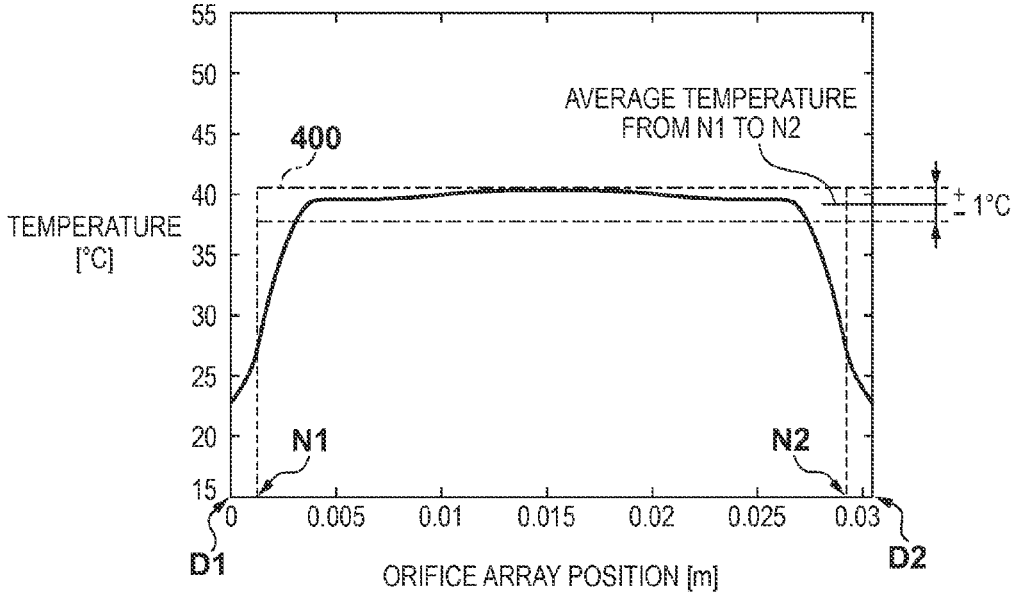
FIGS. 14A and 14B are diagrams for illustrating a temperature distribution of an orifice array according to Embodiment 4.
Figure 14B:
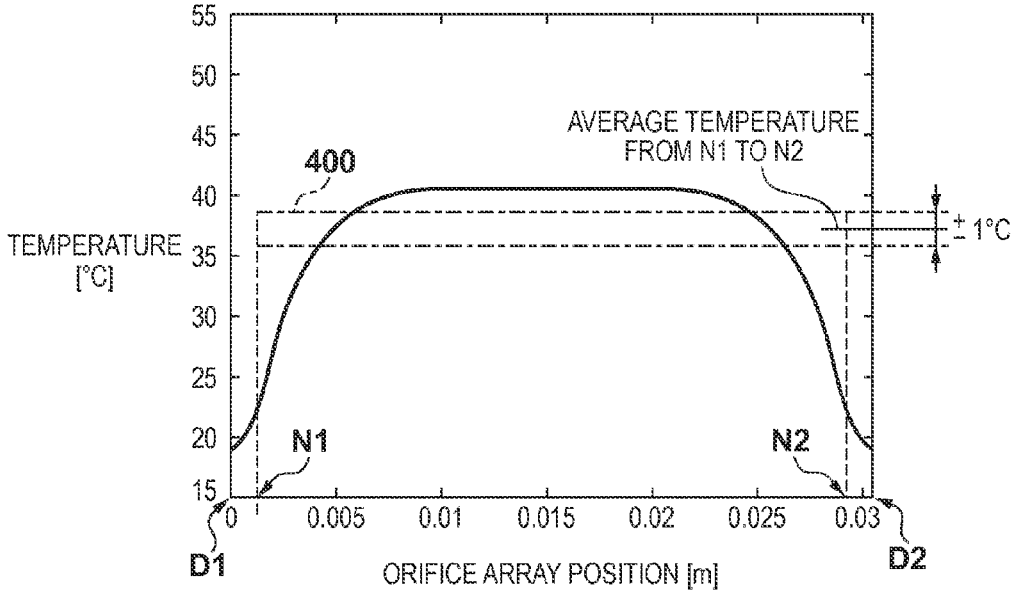

Next is a description of the orifice array temperature distribution obtained after two-stage temperature adjusting processing of Embodiment 4 has been carried out, with reference to FIG. 14A. In order to describe an effect of the present embodiment, FIG. 14B shows a conventional temperature distribution as a reference example. Note that N1, N2, D1, and D2 in FIG. 14A respectively correspond to the same reference signs shown in FIG. 3B.

Similarly to Embodiment 1, a flatness rate was calculated, and the flatness rate of Embodiment 4 will be compared with the flatness rate of the conventional technique. Note that with the conventional technique as well, the measurement results were obtained in the case of heating the printhead to the target temperature of 40° C. when the environmental temperature was 15° C.

A comparison of the two temperature distributions shows that the flatness rate was approximately 83.6% in the temperature distribution of Embodiment 4, and the flatness rate was approximately 12.7% with the conventional technique. It can be understood from these results that the temperature adjusting operation of Embodiment 4 can achieve greater uniformity in the temperature distribution than the temperature adjusting operation of the conventional technique can. Specifically, in the case of performing heating until the same target temperature is reached, there is less temperature variation with the temperature adjusting operation of the present embodiment than with the temperature adjusting operation in the conventional technique.

As described above, according to Embodiment 4, the orifice array temperature distribution along the orifice arrangement direction can be made uniform similarly to Embodiment 1 regardless of the environmental temperature, thus enabling executing the printing operation with a stable ink discharge amount from the start of printing.

Although examples of representative embodiments of the present invention are described above, the present invention is not intended to be limited to the embodiments described above and shown in the drawings, and appropriate modifications can be made without departing from the gist of the prevent invention.

For example, although the example of a two-stage temperature adjusting method in which the printhead (heater board 6) is heated in accordance with two types of temperature adjusting conditions is described in the above embodiments, the present invention is not limited to this. Specifically, the present application proposes a multi-stage temperature adjusting method, such as a three-stage temperature adjusting operation or a four-stage temperature adjusting operation. Also, according to the present invention, the orifice array temperature distribution at the start of printing is ultimately made substantially uniform by using this multi-stage temperature adjusting method. For example, a configuration is possible in which a temperature adjusting operation in which the extent of heating in the region of the central portion of the orifice array is lower than that in a predetermined range from the ends of the orifice array is divided into multiple stages according to the extent of heating in the region including the central portion, and temperature adjusting is performed on the printhead by executing the stages in order. Also, a configuration is possible in which temperature adjusting is performed on the printhead by, for example, repeatedly executing the above-described first temperature adjusting operation and second temperature adjusting operation for respective predetermined time periods.

Also, although the orifice thinning rate is ¼ (25%) in the regions C in the temperature adjusting conditions for the second temperature adjusting operation in some of the embodiments described above, the present invention is not limited to this, and this thinning rate of course changes according to, for example, the target temperature, the initial temperature, the driving frequency, and the number of orifices. In other words, it is sufficient that the thinning rate is changed appropriately.

Furthermore, instead of thinning out the number of orifices, a configuration is possible in which the application time (pulse width) or application voltage of the pulse applied to heaters is changed. For example, a configuration is possible in which the second temperature adjusting operation is performed using, for example, a pulse width that is shorter than the pulse width in the first temperature adjusting operation. Alternatively, a configuration is possible in which the second temperature adjusting operation is performed using, for example, an application voltage that is lower than the application voltage in the first temperature adjusting operation. In other words, any technique may be used as long as it is possible to achieve a total heating value similar to that of the above-described embodiments in terms of the entirety of the printhead (heater board) instead of a local heating value distribution.

As described above, the present invention enables executing the printing operation with a stable ink discharge amount from the start of printing, while suppressing cost.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-032626, filed Feb. 17, 2011, which is hereby incorporated by reference herein in its entirety.

What is claimed is:

1. A printing apparatus comprising:

a printhead that has arranged thereon a plurality of orifices and a plurality of electrothermal transducers, corresponding to the plurality of orifices, that generate thermal energy to be applied to ink in order to discharge the ink;

a first control unit configured to cause the printhead to execute a first temperature adjusting operation in which heating of the printhead is performed by applying a voltage, at which ink is not discharged from the orifices, to each of the electrothermal transducers in a region in the printhead in which substantially all of the orifices are arranged;

a second control unit configured to cause the printhead to execute a second temperature adjusting operation in which heating of the printhead is performed by applying a voltage, at which ink is not discharged from the orifices, to a part of the plurality of the electrothermal transducers, such that an extent of heating in a first predetermined region in the printhead, in which a predetermined number of orifices from respective ends in an orifice arrangement direction are arranged, is greater than an extent of heating of a second predetermined region not included in the first predetermined region; and a temperature adjusting control unit configured to cause the first control unit to execute the first temperature adjusting operation and cause the second control unit to execute the second temperature adjusting operation, before printing starts.

2. The printing apparatus according to claim 1, wherein the second control unit lowers the extent of heating by reducing the number of orifices for which the corresponding electrothermal transducer receives application of the voltage in the second predetermined region.

3. The printing apparatus according to claim 1, wherein the second control unit lowers the extent of heating by, compared to the first predetermined region, reducing a voltage value of or shortening an application time of the voltage applied to each of the electrothermal transducers corresponding to the plurality of orifices arranged in the second predetermined region.

4. The printing apparatus according to claim 1, wherein the second control unit performs heating in the first predetermined region with the same extent of heating as that in the first temperature adjusting operation.

5. The printing apparatus according to claim 1, wherein the second control unit divides the second predetermined region into a plurality of divided regions and performs heating with a different extent of heating in each of the divided regions.

6. The printing apparatus according to claim 1, wherein the temperature adjusting control unit causes the first temperature adjusting operation to be executed, and thereafter causes the second temperature adjusting operation to be executed.

7. The printing apparatus according to claim 1, wherein the first control unit causes the printhead to execute the first temperature adjusting operation, such that, in the printhead, a temperature of a central portion of the region in the printhead in which substantially all of the plurality of orifices are arranged is higher than that of an end portion of the region.

8. The printing apparatus according to claim 1, wherein the first control unit causes the printhead to execute the first temperature adjusting operation, such that, in the print head, a temperature distribution in the orifice arrangement direction forms a mountain-shaped distribution, in which the highest temperature is in the vicinity of the center of the region in the printhead in which substantially all of the plurality of orifices are arranged.

9. The printing apparatus according to claim 1, further comprising a temperature sensor configured to sense a temperature of the printhead, wherein the temperature adjusting control unit causes the first control unit to execute the first temperature adjusting operation and causes the second control unit to execute the second temperature adjusting operation, based on a sensing result of the temperature sensor.

10. The printing apparatus according to claim 9, wherein the printhead includes the temperature sensor.

11. The printing apparatus according to claim 9, wherein the temperature adjusting control unit causes the first control unit to execute the first temperature adjusting operation and causes the second control unit to execute the second temperature adjusting operation, in a case where the temperature based on the sensing result is equal to or lower than a first predetermined temperature.

12. The printing apparatus according to claim 11, wherein in a case where the temperature based on the sensing result is equal to or lower than the first predetermined temperature, the temperature adjusting control unit causes the first control unit to execute the first temperature adjusting operation, and in a case where the temperature based on the sensing result is equal to or higher than a second predetermined temperature, the temperature adjusting control unit causes the first control unit to finish the first temperature adjusting operation and causes the second control unit to start the second temperature adjusting operation.

13. The printing apparatus according to claim 12, wherein the temperature adjusting control unit causes the first control unit to finish the first temperature adjusting operation and causes the second control unit to finish the second temperature adjusting operation, in a case where the temperature based on the sensing result is equal to or higher than a third predetermined temperature.

14. A printing apparatus comprising:

a printhead that has arranged thereon a plurality of orifices and a plurality of electrothermal transducers, corresponding to the plurality of orifices, that generate thermal energy to be applied to ink in order to discharge the ink;

a first control unit configured to cause the printhead to execute a first temperature adjusting operation in which heating of the printhead is performed by applying a voltage, at which ink is not discharged from the orifices, to each of the electrothermal transducers in a region in the printhead in which substantially all of the orifices are arranged;

a second control unit configured to cause the printhead to execute a second temperature adjusting operation in which heating of the printhead is performed by applying a voltage, at which ink is not discharged from the orifices, to a part of the plurality of the electrothermal transducers, such that an extent of heating in a first predetermined region in the printhead, in which a predetermined number of orifices from respective ends in an orifice arrangement direction are arranged, is greater than an extent of heating of a second predetermined region not included in the first predetermined region;

a temperature adjusting control unit configured to cause the first control unit to execute the first temperature adjusting operation and cause the second control unit to execute the second temperature adjusting operation, before printing starts;

a temperature sensor that is arranged at a position outside the region in the printhead in which substantially all of the plurality of orifices are arranged on the printhead, and that measures the temperature of the printhead; and a holding unit that holds information indicating a relationship that temperature distributions of the printhead along the orifice arrangement direction have with sensor temperatures measured by the temperature sensor when the temperature distributions were obtained, the temperature distributions having been obtained when heating was performed in the first temperature adjusting operation and the second temperature adjusting operation, wherein the temperature adjusting control unit determines an end timing of the first temperature adjusting operation and the second temperature adjusting operation based on the information held by the holding unit.

15. A control method for printing an image on a printing medium using a printhead, the printhead having arranged thereon a plurality of orifices and a plurality of electrothermal transducers, corresponding to the plurality of orifices, that generate thermal energy to be applied to ink in order to discharge the ink, the control method comprising:

causing the printhead to execute a first temperature adjusting operation in which heating of the printhead is performed by applying a voltage, at which ink is not discharged from the orifices, to each of the electrothermal transducers in a region in the printhead in which substantially all of the orifices are arranged; and causing the printhead to execute a second temperature adjusting operation in which heating of the printhead is performed by applying a voltage, at which ink is not discharged from the orifices, to a part of the plurality of the electrothermal transducers, such that an extent of heating in a first predetermined region in the printhead, in which a predetermined number of orifices from respective ends in an orifice arrangement direction are arranged, is greater than an extent of heating of a second predetermined region not included in the first predetermined region, wherein the first temperature adjusting operation and the second temperature adjusting operation are executed before printing starts.

16. The control method according to claim 15, wherein the first temperature adjusting operation and the second temperature adjusting operation are executed based on a temperature of the printhead.

17. The control method according to claim 16, wherein the printhead includes a temperature sensor for sensing the temperature.

18. The control method according to claim 16, wherein the first temperature adjusting operation and the second temperature adjusting operation are executed in a case where the temperature is equal to or lower than a first predetermined temperature.

19. The control method according to claim 18, wherein in a case where the temperature is equal to or lower than the first predetermined temperature, the first temperature adjusting operation is executed, and in a case where the temperature is equal to or higher than a second predetermined temperature, the first temperature adjusting operation is stopped and the second temperature adjusting operation is started.

20. The control method according to claim 19, wherein the first temperature adjusting operation and the second temperature adjusting operation are stopped in a case where the temperature is equal to or higher than a third predetermined temperature.

21. A printing apparatus comprising:

a printhead that has arranged thereon a plurality of orifices and a plurality of electrothermal transducers, corresponding to the plurality of orifices, that generate thermal energy to be applied to ink in order to discharge the ink;

a first control unit configured to cause the printhead to execute a first temperature adjusting operation in which heating of the printhead is performed by applying a voltage, at which ink is not discharged from the orifices, to each of the electrothermal transducers in a region in the printhead in which substantially all of the orifices are arranged;

a second control unit configured to cause the printhead to execute a second temperature adjusting operation in which heating of the printhead is performed by applying a voltage, at which ink is not discharged from the orifices, to a part of the plurality of the electrothermal transducers, such that an extent of heating in a first predetermined region in the printhead, in which a predetermined number of orifices from respective ends in an orifice arrangement direction are arranged, is greater than an extent of heating of a second predetermined region not included in the first predetermined region; and a temperature adjusting control unit configured to cause the first control unit to execute the first temperature adjusting operation and cause the second control unit to execute the second temperature adjusting operation, before printing starts, wherein the printhead includes a heater board on which the plurality of electrothermal transducers are formed, and a base plate for supporting the heater board, in which an ink channel for supplying ink to the heater board is formed and in which a beam is formed in the vicinity of the center of the region in the printhead in which substantially all of the plurality of orifices are arranged.

22. The printing apparatus according to claim 21, wherein the beam is formed in a direction intersecting with the orifice arrangement direction.

* * * * *